US006449442B1

(12) United States Patent
Shida et al.

(10) Patent No.: US 6,449,442 B1
(45) **Date of Patent: *Sep. 10, 2002**

(54) DEVELOPING APPARATUS EMPLOYING PERMEABILITY SENSOR TO DETECT POLYMER TONER DENSITY

(75) Inventors: Masanori Shida, Shizuoka-ken; Yoshiaki Kobayashi, Numazu; Masaru Hibino, Minamiashigara; Ichiro Ozawa, Susono, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/098,328

(22) Filed: Jun. 17, 1998

(30) Foreign Application Priority Data

Jun. 18, 1997 (JP) ..... 9-177546

(51) Int. Cl.[7] ..... G03G 15/10
(52) U.S. Cl. ..... 399/63
(58) Field of Search ..... 399/53, 58, 61, 399/62, 63, 119, 267, 274; 430/106.6, 108, 109, 111, 106.1, 108.1, 109.1, 111.1, 111.34

(56) References Cited

U.S. PATENT DOCUMENTS 4,088,092 A * 5/1978 Noguchi ..... 399/63
4,650,310 A * 3/1987 Hayashida et al. ..... 399/63
4,891,675 A * 1/1990 Asanuma ..... 399/63
5,119,758 A * 6/1992 Inoue et al. ..... 399/63
5,166,729 A * 11/1992 Rathburn et al. ..... 399/63
5,187,522 A * 2/1993 Resch, III ..... 399/63
5,499,082 A * 3/1996 Watanabe et al. ..... 399/274
5,508,793 A * 4/1996 Kimura et al. ..... 399/63
5,510,222 A * 4/1996 Inaba et al. ..... 430/109
5,565,966 A * 10/1996 Ochiai et al. ..... 399/274
5,766,814 A * 6/1998 Baba et al. ..... 430/106.6

OTHER PUBLICATIONS

U.S. application No. 09/099,136, filed Jun. 18, 1998, in Group Art Unit 2852.

* cited by examiner

*Primary Examiner*—Sandra Brase
(74) *Attorney, Agent, or Firm*—Fitzpatrick, Cella, Harper & Scinto

(57) ABSTRACT

A developing apparatus includes a developer container for containing a developer comprising magnetic carrier and non-magnetic toner produced through polymerization method; a developer carrying member, provided in an opening of the developer container, for carrying the developer; detecting means for detecting a toner content in the developer, the detecting means including a coil sensor and detecting the toner content using magnetic permeability of the developer.

12 Claims, 3 Drawing Sheets

DEVELOPING APPARATUS EMPLOYING PERMEABILITY SENSOR TO DETECT POLYMER TONER DENSITY

FIELD OF THE INVENTION AND RELATED ART

The present invention relates to developing apparatuses for developing an electrostatic latent image formed on an image bearing member. In particular, it relates to such a developing apparatus that is employed in image forming apparatuses, for example, copying machines or printers, which employ an electrophotographic recording system, an electrostatic recording system, or the like.

In an electrophotographic image forming apparatus or the like, an electrostatic latent image is formed on the image bearing member, and the latent image is developed with the use of a developing apparatus and developer.

A developing apparatus comprises a developer carrying member which delivers developer close to the peripheral surface of the image bearing member by carrying developer on its peripheral surface. The developer carried close to the peripheral surface of the image bearing member develops an electrostatic latent image on the image bearing member, or visualizes the latent image, as an alternating electric field is formed between the developer carrying member and the image bearing member. Generally, the image bearing member and the developer carrying member are constituted of a photosensitive drum and a development sleeve, respectively.

There are several methods for developing a latent image. One of the well known methods is the method which employs two component developer composed of carrier and toner. According to this method, a magnetic brush is formed of this developer by the magnet encased in a development sleeve, on the peripheral surface of the development sleeve which is disposed in such a manner that a microscopic gap is maintained between the peripheral surfaces of the development sleeve and the image bearing member. A latent image formed on the image bearing member is developed as the magnetic brush brushes, or virtually touches, the peripheral surface of the image bearing member. As for the alternating electric field formed between the development sleeve and the photosensitive drum, there are two types: an alternating electric field (Japanese Laid-Open Patent Application Nos. 34060/1980 and 165082/1984) and a DC electric field.

A development apparatus based on a magnetic brush formed of two component developer is generally structured as depicted in FIG. 4. In the drawing, a referential figure 105 designates a developer container of a developing apparatus which relies on a magnetic brush form of two component developer. The developer container 105 contains two component developer 103, that is, a mixture of nonmagnetic toner and magnetic carrier. The developer container 105 has a wide opening which faces a photosensitive drum 100. In this wide opening, a development sleeve 109 is disposed, and in the development sleeve, a magnetic roller is nonrotatively disposed. The positional relationship between the development sleeve 109 and photosensitive drum 100 is such that a predetermined gap is always maintained between the peripheral surfaces of the development sleeve 109 and the photosensitive drum 100. Above the development sleeve 109, a regulator blade 111 is attached to the developer container 105. This blade 111 regulates the thickness of the developer layer formed on the peripheral surface of the development sleeve 109. Approximately the bottom half of the internal space of the developer container 105 is partitioned into a developer space R1 and a stirring space R2 by a partition wall 113. Above the stirring space R2, a toner storage space R2 is located, which stores the replenishment toner 119.

The development sleeve 109 is rotated in such a direction that the peripheral surfaces of the development sleeve 109 and the photosensitive drum 100 move in the same direction at the location where the two surfaces face each other. As the development sleeve 109 is rotated, the two component developer 103 in the developer container 105 is adhered to the peripheral surface of the development sleeve 109 by the effect of the magnetic roller 107, and then, is carried to the location at which the peripheral surfaces of the development sleeve 109 and the photosensitive drum 100 face each other. As stated above, there is provided a gap 125 between the peripheral surfaces of the development sleeve 109 and the photosensitive drum 100 so that the developer on the development sleeve 109 develops the electrostatic latent image on the peripheral surface of the photosensitive drum 100 as the developer makes contact with the peripheral surface of the photosensitive drum 100.

The toner density of the two component developer 103 within the developer container 105, that is, the ratio (T/C ratio) of the amount of the toner relative to the amount of the carrier in the developer, is kept constant by allowing the toner in the toner storage space R3 to free fall through a replenishment hole in the bottom wall of the toner storage space R3, by the same amount as the amount of toner consumed through development activity.

As for the method for detecting and/or maintaining the T/C ratio of the developer within the developer container 105, various methods have been proposed, and some of them have been put to practical use. For example, according to one of the methods, an optical density sensor is disposed adjacent to the photosensitive drum 100. In obtaining the T/C ratio, light is projected upon a toner image formed on the peripheral surface of the photosensitive drum 100 by developing the latent image formed on the peripheral surface of the photosensitive drum 100, and the amount of the light which is transmitted through, or is reflected by, the tuner image is detected by the optical density sensor. Then, the T/C ratio is determined from the detected amount of the light. The amount of the toner allowed to free fall is adjusted according to the thus obtained T/C ratio, to keep the T/C ratio of the developer constant. According to another method, an optical density sensor is disposed on the development sleeve 109. In obtaining the T/C ratio, light is projected upon the developer layer on the peripheral surface of the development sleeve 109, and the T/C ratio is determined from the amount of the light reflected by the developer layer. Then, the amount of the toner to be added to the developer is adjusted according to the thus obtained T/C ratio of the developer.

However, the former method that maintains the T/C ratio of the developer in the developer container 105 on the basis of the toner density of the toner image suffers from the problem that it is very difficult to find a space for the sensor in a developing apparatus since the size of copying machines and image forming apparatuses has been continuously reduced in recent years. The latter method, that is, the method that maintains the T/C ratio in the developer container 105 on the basis of the detected T/C ratio of the toner layer on the development sleeve 109, also suffers from a problem, that is, the problem that the sensor is contaminated due to the scattering of the toner particles, failing to accurately detect the T/C ratio of the developer layer on the peripheral surface of the development sleeve 109.

Fortunately, there is another method for maintaining the T/C ratio of the developer in the developer container 105. According to this third method, a sensor of a coil type is disposed as the toner density sensor in the developer container 105, to obtain the apparent permeability of a specific volume of the developer; the inductance of the coil of the sensor is measured. Then, the amount of the toner to be added is adjusted on the basis of the thus obtained T/C ratio of the specific volume of the developer adjacent to the coil type sensor.

More specifically, according to this method that employs a toner density sensor of a coil type, the increase in the permeability of a specific volume of the developer means the decrease in the T/C ratio of the specific volume of the developer, that is, the decrease in the toner density of the developer. Therefore, as the permeability of the specific amount of the developer increases, toner replenishment is started. On the other hand, the decrease in the permeability of the specific volume of the developer means the increase in the T/C ratio of the specific volume of the developer, that is, the increase in the toner density of the developer, and therefore, as the permeability of the specific volume of the developer decreases, toner replenishment is stopped.

The toner density sensor of a coil type employed in this third method is inexpensive in unit cost, does not create the aforementioned problem pertaining to the installation space, or the sensor contamination by the scattering of the toner particles. Therefore, a T/C ratio detecting means employing a coil type toner density sensor, and a toner density controlling apparatus employing such a T/C ratio detecting means, are best for an inexpensive copying machine or image forming apparatus, which has only a small internal space.

Yet, even a coil type toner density sensor has its own problem. That is, if the bulk density of the developer in the developer container 105 is affected for one reason or another, the apparent permeability of the developer also affected. Therefore, the sensor output may change even if the T/C ratio of the developer In the developer container 105 remains virtually the same. In other words, such a situation may occur that a signal which indicates the decrease in toner density is outputted, starting toner replenishment, even when the toner density of the developer in the developer container 105 has not decreased, or that the signal which indicates the decreases in the toner density is not being outputted, fails to start the toner replenishment, in spite of the fact that the toner density has decreased.

In the case of the first scenario, an excessive amount of toner is supplied, causing the following problems. For example, the excessive amount of replenished toner renders image density undesirably high, causes the developer to overflow from the developer container 105, and/or renders the toner ratio of the developer in the developer container 105 excessively high, preventing the toner from being charged to the desirable potential level, which in turns allows the toner particles to scatter. In the case of the latter scenario, the amount of the toner in the developer in the developer container 105 decreases, causing the following problems. For example, the decrease in the amount of toner renders image quality inferior, renders the image density low, or causes the toner to be charged to an undesirably high potential level, which in turn renders the image density to be undesirably low.

Thus, the inventors of the present invention studied the causes of the change in the bulk density of the developer in the developer container 105, and discovered the following.

First, the bulk density of the developer is greatly affected by the particle shape of the developer. The particles of the toner produced by pulverization or the like are irregular in shape; they are different from each other in shape. Therefore, the bulk density of the developer containing such toner is liable to change depending on whether the developer is in a static state or is flowing, and whether a developing apparatus containing such developer is operational or not. Further, the shape of the toner particle produced by pulverization, in a batch of developer is liable to change as the batch of developer is in use for a substantial length of time. Among the types of the bulk density change described above, the one attributable to the toner particle shape change which occurs while the developer is in use for a substantial period of time is the largest.

The second cause for the bulk density change is the compression of the developer. More specifically, as the development sleeve 109 is rotated in the same direction as the photosensitive drum 100, and the thickness of the layer of the developer coated on the peripheral surface of the development sleeve 109 is regulated by the regulator blade, a certain amount of the developer is trapped adjacent to the regulator blade 111, being thereby compressed. Further, in order to cause the two component developer in the developer container 105 to be borne on the development sleeve 109 by the magnetic force, the magnetic roller 107 must be such that the magnetic force at the magnetic poles N3 and S2 must be powerful enough to pick up a sufficient amount of the developer. Such a magnetic roller magnetically generates a strong magnetic field between the development sleeve 109 and the regulator blade 111, and the trapped developer is gradually compressed, magnetically as well as mechanically, causing the shape of the toner particles in the developer to change, or the additive particles to be compressed into developer particles. As a result, the bulk density of the developer changes.

Thirdly, the bulk density of the developer is affected by the amount of charge each toner particle carries. That is, in the case of a developing apparatus in which the peripheral surface of the development sleeve is rotated in the same direction as the peripheral surface of photosensitive drum at the location where the two surfaces become closest to each other, a certain amount of the developer is trapped and compressed, increasing the developer density in this area, as described above, which in turn increases the amount of triboelectrical charge given to the toner particles. In other words, the amount of charge toner particles receive increases substantially in proportion to the number of the developer sleeve rotations to which each toner particle is subjected. Obviously, the larger the amount of electrical charge each toner particle carries, the larger the repulsive force between the adjacent two toner particles, and therefore, the greater the distance between the adjacent two toner particles becomes, that is, the smaller the bulk density of the developer becomes.

SUMMARY OF THE INVENTION

The primary object of the present invention is to provide a developing apparatus in which toner density is detected on the basis of change in the permeability of developer.

Another object of the present invention is to provide a developing apparatus in which change in the bulk density of developer is small.

Another object of the present invention is to provide a developing apparatus comprising: a developer container for containing developer composed of magnetic carrier, and nonmagnetic toner manufactured by polymerization; a developer carrying member, which is disposed in the opening of the developer container to carry the developer; and means for detecting the toner density of the developer, which is constituted of a coil type sensor, and detects the toner density of the developer on the basis of the permeability of the developer.

These and other objects, features and advantages of the present invention will become more apparent upon a consideration of the following description of the preferred embodiments of the present invention, taken in conjunction with the accompanying drawings.

DETAILED DESCRIPTION OF THE PREFERRED EMBODIMENTS

Hereinafter, the embodiments of the present invention will be described with reference to the drawings.

Figure 1:
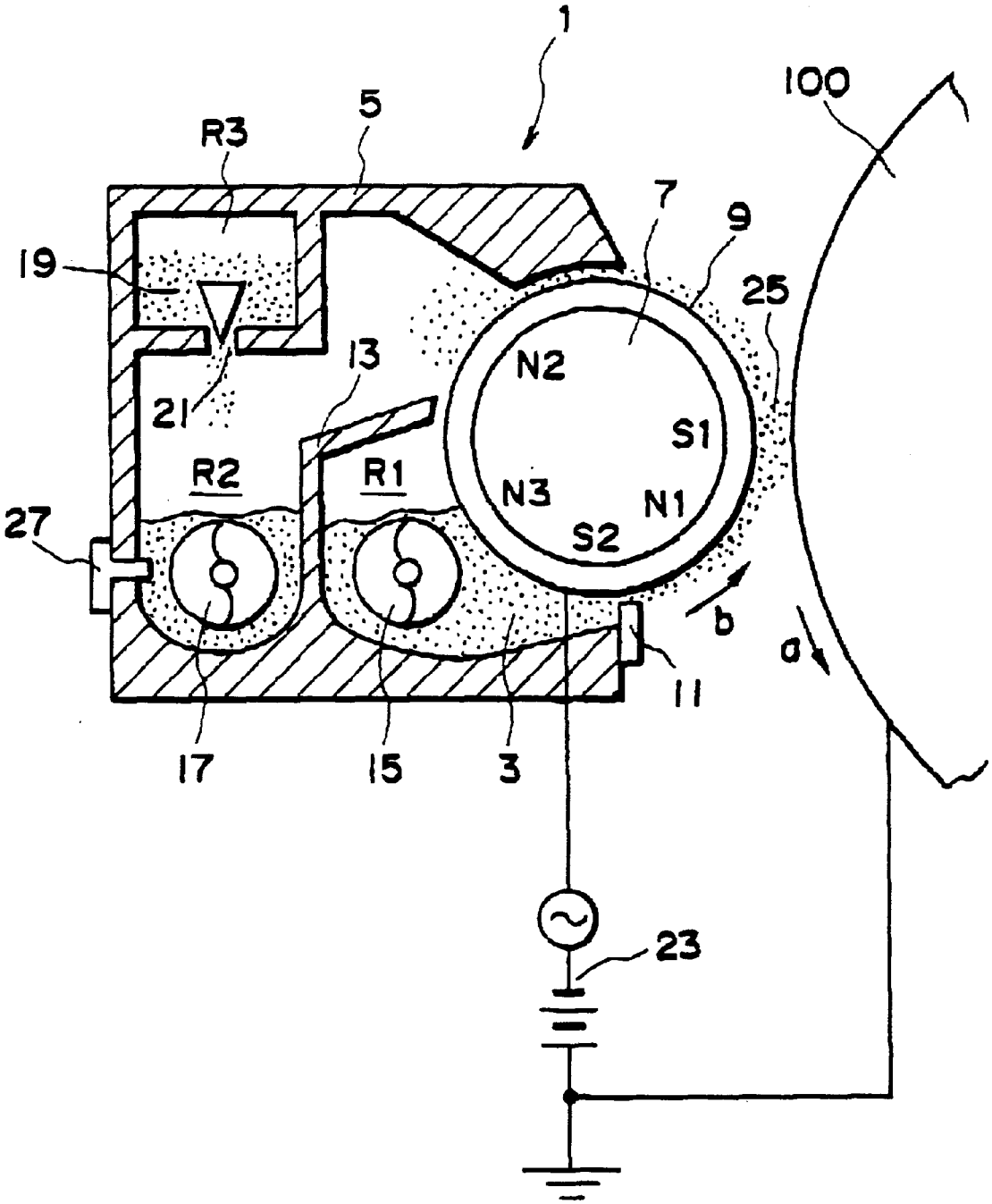
FIG. 1 is a schematic section of a typical developing apparatus in accordance with the present invention.

FIG. 1 is a schematic section of the developing apparatus in the first embodiment of the present invention. A developing apparatus 1 is provided with a developer container 5 which stores two component developer 3 composed of nonmagnetic toner and magnetic carrier. The developer container 5 has a wide opening, which faces the photosensitive drum 100, and in this opening a development sleeve 9 is disposed, holding a predetermined gap between its peripheral surface and the peripheral surface of the photosensitive drum 100. Within the development sleeve 9, a magnetic roller 7 is nonrotatively disposed. The magnetic roller 7 has magnetic poles N1, S1, N2, N3, and S2.

The developing apparatus also has a regulator blade 11, which is disposed in such a manner that the tip of the blade 11 is a predetermined small distance away from the development sleeve 9. According to this embodiment, this regulator blade 11 is disposed below the development sleeve 9 in order to prevent the deterioration of the developer 3, so that the change in the bulk density of the developer attributable to the deterioration of the developer 3 can be prevented.

Approximately the bottom half of the internal space of the developer container 5 is partitioned into a developer space R1 and a stirring space R2 by a partitioning wall 13 which protrudes toward the development sleeve 9. In the two space R1 and R2, developer conveying screws 15 and 17 are disposed, respectively. Above the stirring space R2, a toner storage room R3 is located, which stores the toner for replenishment, and has an opening 21 in its bottom wall. The replenishment toner is released through this opening 21.

As the developer conveying screw 15 rotates, the developer in the developer room R1 is conveyed in the predetermined direction in parallel to the longitudinal direction of the development sleeve 9. The partitioning wall 13 is provided with two unillustrated openings, one at each end of the partition wall 13. The developer conveyed to one end of the developer space R1 is sent into the stirring space R2 through one of the two openings of the partitioning wall 13, and then is received by the developer conveying screw 17. The rotational direction of the screw 17 is rendered opposite to that of the screw 15, so that the developer in the stirring space R2, the developer delivered from the developer space R1, and the developer supplied from the toner storage space R3 are conveyed in the stirring space R2 in the direction opposite to the developer conveying direction of the screw 15, being stirred and mixed, and are sent into the developer space R1 through the other opening of the partitioning wall 13.

The development sleeve 9 is constituted of a cylinder of nonmagnetic material such as aluminum or nonmagnetic stainless steel, and its peripheral surface is provided with a proper degree of roughness. According to the present invention, in order to prevent the deterioration of the developer 3, which affects the bulk density of the developer, the development sleeve 9 is rotated in the direction indicated by an arrow mark b, rendering the moving direction of the peripheral surface of the development sleeve 9 opposite to the moving direction of the peripheral surface at the location where the peripheral surfaces of the development sleeve 9 and the photosensitive drum 100 are closest to each other; the development sleeve 9 is "counter rotated" relative to the photosensitive drum 100.

It is in the following manner that an electrostatic latent image formed on the peripheral surface of the photosensitive drum 100 is developed by the developing apparatus 1 structured as described above. First, the development sleeve 9 is "counter rotated," and as it is rotated, the developer in the developer room R1 is picked up on the peripheral surface of the development sleeve 9 by the magnetic force of the magnetic poles N3 and S2. As the development sleeve 9 further rotates, the developer picked up in layer an the peripheral surface of the development sleeve 9 is carried to the regulator blade 11, which regulates the layer of the developer 3 on the development sleeve 9 to a proper thickness, and thereafter, the thin layer of the developer 3 with a proper thickness reaches a development zone 25 in which the distance between the peripheral surfaces of the development sleeve 9 and the photosensitive drum 100 is smallest. The development zone 25 corresponds to the magnetic pole S1 (developing pole) of the magnetic roller 7 in terms of location, and therefore, a magnetic field for development is formed in the development zone 25 by the development pole S1. With the presence of this development magnetic field, the developer particles on the peripheral surface of the development sleeve 9 aggregate in the shape of the tip of a brush; in other words, a magnetic brush is formed of the developer in the development zone 25. This magnetic brush makes contact with the peripheral surface of the photosensitive drum 100, and therefore, the toner particles within the magnetic brush and the toner particles adhering to the peripheral surface of the development sleeve 9 adhere to the appropriate areas of the electrostatic latent image on the peripheral surface of the photosensitive drum 100; the latent image is developed into a toner image.

In order to facilitate the development process, it is desirable that compound voltage composed of DC voltage and AC voltage is applied between the development sleeve 9 and the photosensitive drum 100 from a bias power source 23. The peripheral velocity $V_b$ of the development sleeve 9 is desired to have a ratio in a range of 130–200% relative to the peripheral velocity of the photosensitive drum 100. If the peripheral velocity ratio of the development sleeve 9 relative to that of the photosensitive drum 100 is no more than 130%, satisfactory image density cannot be realized, and if it is no less than 200%, toner particles scatter. The preferable range is between 150–180%.

The developer particles remaining on the peripheral surface of the development sleeve 9 after a development process are returned to the developer container 5 as the development sleeve 9 rotates, and are stripped from the development sleeve 9 by the repulsive magnetic field generated by the magnetic poles N2 and N3, falling into the developer room R1 or the stirring room R2.

As the T/C ratio (ratio of the amount of the toner relative to the amount of the carrier, that is, the toner density of the developer) of the developer 3 in the developer container 5 is reduced through the development activity described above, the toner 19 in the toner storage room R3 is allowed to free fall into the stirring room R2 by the amount equal to the amount of the toner consumed through the development activity, to maintain the T/C ratio of the developer 3 at a predetermined level. In this embodiment, a coil type density sensor is employed to detect the T/C ratio of the developer 3 in the developer container 5.

Referring to FIG. 1, a coil type density sensor comprises a coil 27 as an actual sensor portion, which is placed at the same height as the conveying screw 17 in the stirring room R2. The reason for choosing this height for the coil 27 is as follows. That is, in order to accurately determine the amount of the change in the permeability of the developer 3 from the amount of the change in the inductance of the coil 27, that is, in order to accurately detect the change in the T/C ratio of the developer 3, the detecting surface of the coil 27 must be completely covered with the developer particles which are steadily conveyed, while being stirred, by the conveying screw 17. It should be noted here that, in principle, the coil type density sensor may be placed anywhere in the developer container 5 as long as the location meets the requirement described above.

As described before, the bulk density of developer is affected by the deterioration of the developer caused by usage. Therefore, in this embodiment, in order to reduce the change in the bulk density of the developer 3 by reducing the amount of the deterioration of the developer 3, nonmagnetic toner (polymer toner) which is manufactured by polymerization, and the shape of the particle of which is spherical, is used as one of the two components of the developer 3, so that the toner density of the developer 13 is accurately detected by a coil type toner density sensor. More specifically, nonmagnetic toner manufactured by suspension polymerization from a compound composed of monomer, coloring agent, and charge controlling agent, and suspended in water (medium). The polymerizing method does not need to be limited to the suspension polymerization; emulsion polymerization may be employed. Further, additives other than those listed above may be added.

The shape factors SF-1 and SF-2 of the polymer toner, in particular, the polymer toner manufactured by suspension polymerization, is in a range of 100–140 and a range of 100–120, respectively. The definitions of the shape factors SF-1 and SF-2 are as follows:

$$\text{SF-1}=\{(\text{MXLNG})2/\text{AREA}\}\times(\pi/4)\times 100$$

$$\text{SF-2}=\{(\text{PERl})2/\text{AREA}\}\times(\pi/4)\times 100$$

AREA: projected area size of toner particle;

MXLNG: absolute maximum length;

PERl: peripheral length.

In actually obtaining the shape factors SF-1 and SF-2 of the polymer toner, first, one hundred toner particles are randomly selected with the use of an electron microscope FE-SEM (S-800), a product of Hitachi, Ltd., and their image data are inputted into an image analyzing apparatus Luscex 3, a product of Nicole Co., Ltd. Then, the shape factors SF-1 and SF-2 for the polymer toner used in this embodiment are calculated by substituting the values obtained by the analyses of the image data, for AREA, MXLNG, and PERl in the above equations.

The shape factor SF-1 indicates the degree in the sphericality; the greater the value of SF-1 of a particle, the less spherical is the particle. The shape factor SF-2 indicates the degree in surface roughness; the greater the value of SF-2 of a particle, the rougher is the surface of the particle.

The shape factors SF-1 and SF-2 of the conventional toner manufactured by pulverization are in a range of 180–220 and a range of 180–200, respectively. In comparison, the shape factors SF-1 and SF-2 of the polymer toner used in this embodiment is in a range of 100–140 and a range of 100–120, respectively, proving that the polymer toner in this embodiment is closer to being truly spherical.

The polymer toner does not change in the shape factor compared to the conventional pulverization toner; in other words, the polymer toner deteriorates less in terms of particle shape than the conventional pulverization toner. For example, if a developing apparatus which contains the developer composed of the aforementioned pulverization toner is operated for five hours, the ranges of the shape factors SF-1 and SF-2 of the pulverization toner in this developer change to a range of 120–150 and a range of 120–140, respectively; the toner particles become nearly spherical. On the other hand, under the same operational condition, the shape factors SF-1 and SF-2 of the polymerization toner change very little, remaining in substantially the same range of 100–120 and 100–120, respectively, as they are at the beginning of the development operation, This is thought to be due to the following reason. That is, in the case of the pulverization toner, the rough edges which are on the peripheral surface of a pulverization toner particle are shaved away by the friction between toner particles and carrier particles adjacent to the toner particles, and also the friction between adjacent toner particles, and as a result, the shape of the toner particles becomes closer to being truly spherical; in other words, the change in the shape factor is relatively large. On the other hand, in the case of the polymer toner, the shape of its particles is nearly spherical to begin with, and the surface of its particles does not have the characteristic that causes the pulverization toner particles to change shape. Therefore, the change in the shape of the particles of the polymerization toner is relatively small.

As is evident from the explanation given above, the particle shape of the toner produced by pulverization changes greatly, and therefore, is greater in the change in the size of the interface between the adjacent two toner particles. Thus, the gap between adjacent particles of the pulverization toner changes greatly; in other words, the pulverization toner is large in terms of change in bulk density, compared to the polymer toner. Therefore, if a coil type sensor is used as the toner density sensor, and polymer toner is used as the toner of the two component developer, the output fluctuation of the toner density sensor is reduced; the T/C ratio of the developer can be more accurately detected.

Figure 4:
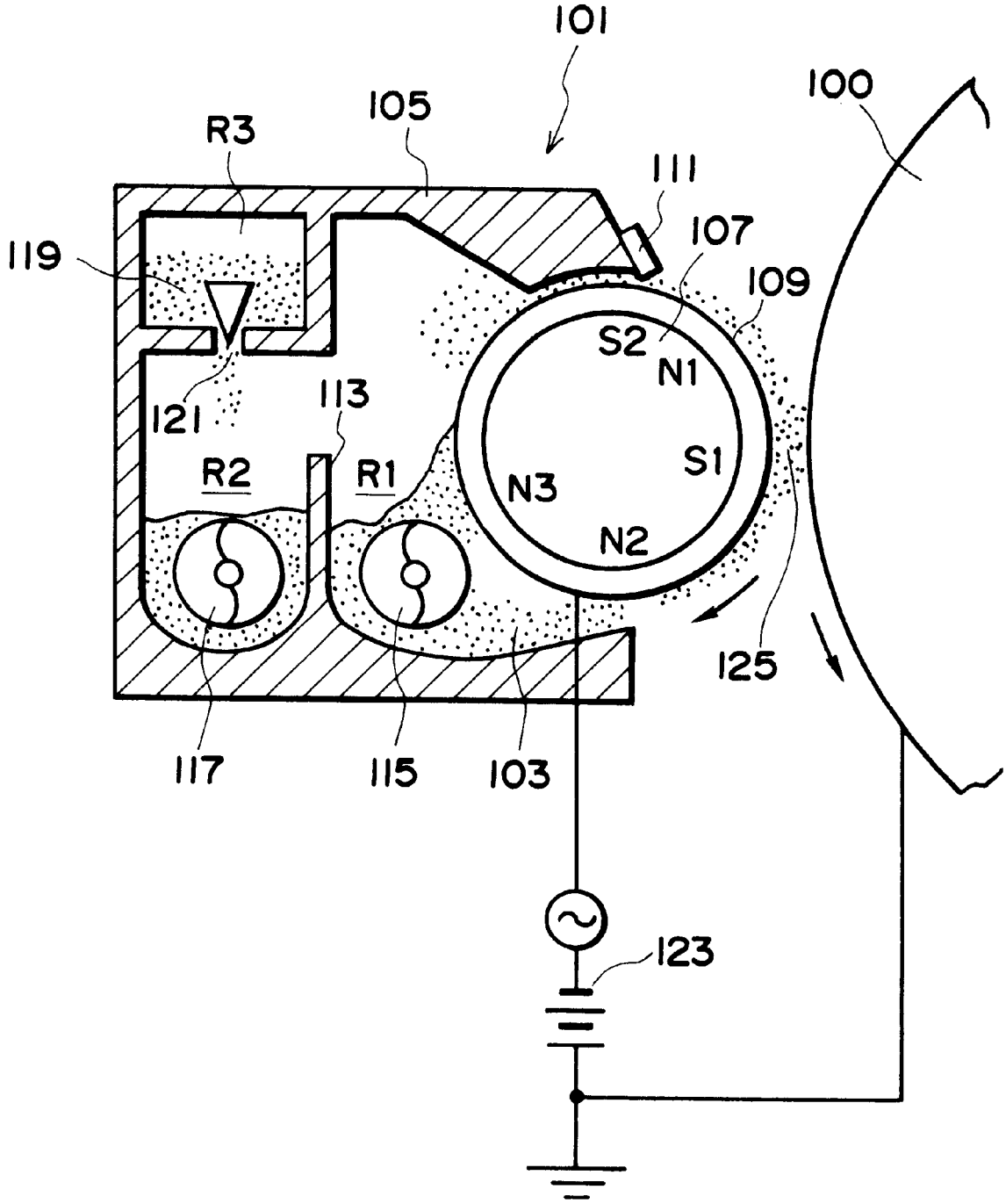
FIG. 4 PRIOR ART
FIG. 4 is a schematic section of a developing apparatus prior to the present invention.

As described before, in the case of a conventional developing apparatus, the development sleeve 109 is rotated in such a direction that the peripheral surfaces of the development sleeve 109 and the photosensitive drum 100 move in the same direction at the location where their distance becomes smallest, and the regulator sleeve 111 is disposed above the development sleeve 109 as illustrated in FIG. 4. Therefore, the developer deposited in layer on the peripheral surface of the development sleeve 109 by the magnetic force from the magnetic poles N3 and S2 is carried toward the regulator blade 111 disposed above the development sleeve 109, is accumulated in the space adjacent to the interface between the regulator blade 111 and development sleeve 109, and then is compressed by the surface of the regulator blade 111 and the peripheral surface of the development sleeve 109.

In comparison, in the case of the developing apparatus in this embodiment illustrated in FIG. 1, the development sleeve 9 is rotated in the direction indicated by the arrow mark b, that is, in such a direction that the peripheral surfaces of the development sleeve 9 and the photosensitive drum 100 move in the opposite directions, and the regulator blade 11 is disposed below the development sleeve 9. Therefore, the developer is attached to the peripheral surface of the development sleeve 9 by the magnetic force from the magnetic poles N3 and S2 of the magnetic roller 7, and the developer attached to the development sleeve 9 is carried to the regulator blade 11 disposed below the development sleeve 9, being regulated thereby. Thus, the mechanism for picking up the developer from the developer container 5 is unnecessary; it is possible to employ, as the magnetic roller for the development sleeve 9, a magnetic roller, the magnetic force of which at the magnetic poles S2 and N3 is less than that of the conventional apparatus. Therefore, it is possible to reduce the magnetic force that confines the developer in the space between the development sleeve 9 and the regulator blade 11. Further, it is unnecessary to cause a certain amount of the developer to accumulate in the space adjacent to the upstream side of the gap between the development sleeve 9 and the regulator blade 11, in terms of the rotational direction of the development sleeve 9, in the same manner as the certain amount of the developer is accumulated in the conventional developing apparatus in order to prevent the developer from being unevenly coated on the development sleeve 109. Therefore, the phenomenon that the developer is compressed at the aforementioned space adjacent to the upstream side of the gap between the development sleeve 9 and the regulator blade 11 does not occur according to this embodiment. Thus, it is possible to reduce the amount of developer deterioration which in turn makes it possible to reduce the fluctuation of the amount of triboelectrical charge potential that the toner particles receive.

In essence, In this embodiment, the change in the shape of the toner particles attributable to the compression of the developer is reduced, which in turn reduces the change in the bulk density of the developer attributable to the change in the shape of the toner particles. This in turn reduces the fluctuation of the amount of the charge that the toner particles receive, which in turn reduces the fluctuation of the force generated between adjacent toner particles in the direction to cause the toner particles to repel against each other. This in turn reduces the change in the bulk density of the developer. Further, a coil type density sensor is employed as the toner density sensor for the developing apparatus. Therefore, the T/C ratio of the developer is more accurately detected to desirably control the toner density of the developer in the developer container.

The effectiveness of this embodiment was confirmed by a test in which a Canon copying machine CLC-700, the developing device of which had been modified according to this embodiment, was used to produce 50,000 copies while varying the image ratio of originals. As for the toner density control, in order to maintain the T/C ratio of the developer at 7% with a tolerance of ±1%, toner replenishment was started when the T/C ratio of the developer dropped to 6%, and was stopped as soon as the T/C ratio rose to 8%.

Figure 2:
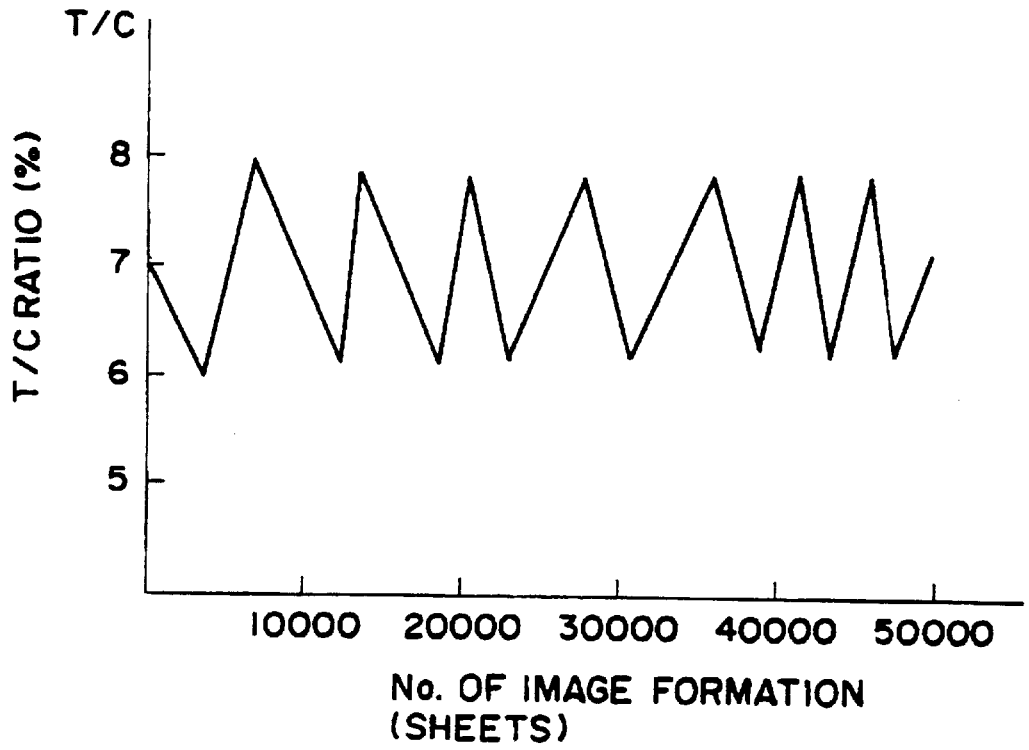
FIG. 2 is a graph showing the change in the T/C ratio of the developer in the developing apparatus, which occurred when the T/C ratio was controlled on the basis of the toner density of the developer detected by a coil type sensor.

The results of the test are given in FIG. 2. As is evident from FIG. 2, the T/C ratio of the developer could be desirably controlled with the tolerance of ±1%.

Next, another embodiment of the present invention will be described.

In the preceding embodiment, in order to reduce the change in the bulk density of the two component developer, the development sleeve 9 is rotated in such a direction that the peripheral surfaces of the development sleeve 9 and the photosensitive drum 100 move in the opposite directions at the location where the two surfaces become closest to each other; the regulator blade 11 is disposed below the development sleeve 9; and two component developer is used, the toner of which is nonmagnetic polymer toner manufactured by polymerization, and the particles of which are spherical.

In other words, this embodiment is basically the same as the preceding embodiment, except that the material for the magnetic carrier is different. In this embodiment, magnetic carrier with higher electrical resistance is used to control the change in the bulk density of the two component developer.

More specifically, a carrier composed of magnetic resin with high electrical resistance is used, which is manufactured from binder resin, magnetic metallic oxide, and nonmagnetic metallic oxide, by polymerization. However, the magnetic carrier mentioned above may be replaced with a magnetic carrier with high electrical resistance manufactured by the method other than the one mentioned above.

Figure 3:
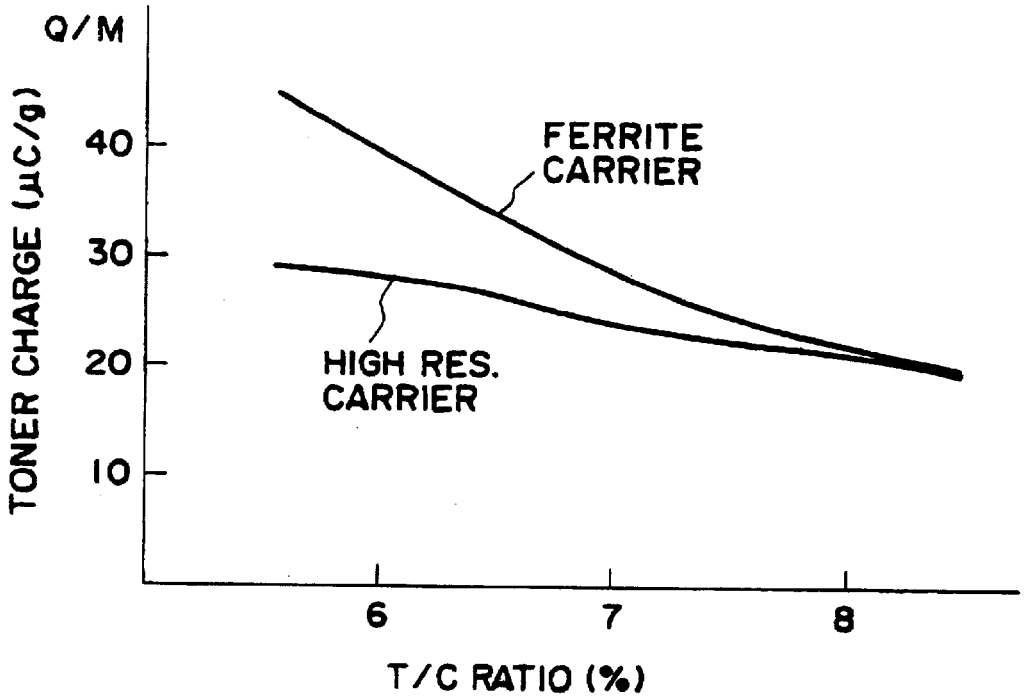
FIG. 3 is a graph showing the change in the amount of the toner charge, relative to the change in the T/C ratio of the developer, which occurred when the magnetic carrier with high electrical resistance was used in an embodiment of the present invention, and when the conventional magnetic carrier composed of ferric material was used.

FIG. 3 is a graph showing the change in the amount of the toner charge, relative to the change in the T/C ratio of the developer, which occurred when the magnetic carrier (carrier composed of magnetic resin) with high electrical resistance in this embodiment was used, and when the conventional magnetic carrier composed of ferric material was used, respectively. As is evident from FIG. 3, in the case of the conventional magnetic carrier of the ferrite type, the change in the toner charge is relatively large, whereas in the case of the resin type magnetic carrier with high electrical resistance in this embodiment (carrier with a low level of magnetism), the amount of the toner charge changes very little. This difference in the change in the amount of toner charge is thought to be due to the following.

The shape factors SF-1 and SF-2 of the carrier of the ferrite type are in ranges of 140–180 and 145–185, respectively; the surface of each particle of the ferrite type carrier is rougher than that of the polymer resin type carrier. Therefore, the contact area between a ferrite type carrier particle and a toner particle is larger than that between a polymer resin type carrier particle and a toner particle, causing the ferrite type carrier to give a larger amount of triboelectrically charge to each toner than the polymer resin type carrier. Further, the ferrite type carrier is low in electrical resistance, and therefore, it does not internally accumulate a large amount of the charge which it receives while triboelectrically charging the toner particles, and the polarity of which is opposite to the polarity of the toner particles. In other words, the ferrite type carrier is difficult to saturate with electrical charge, which means that the ferrite type carrier can give each toner particle a larger amount of charge than the polymer resin type carrier. Thus, in the case of the ferrite type carrier, the amount of the triboelectrical charge the toner particles receive changes greatly in response to the change in the T/C ratio, since the T/C ratio affects the frequency at which the toner particles and the carrier particles make contact. However, the higher the T/C ratio, the greater the number of toner particles which cover the surface area of each carrier particle, and therefore, the smaller the contact surface between each toner particle and the carrier, which means that the higher the T/C ratio the smaller the change in the amount of the triboelectrical charge the toner particles receive. Because of the explanation given above, in the case of the ferrite type carrier, the amount of the toner charge remains substantially high when the T/C ratio is relative low, that is, in an approximate range of 5.5–8.5% in FIG. 3, and reduces as the T/C ratio increases, that is, remains relatively small in the range in which the T/C ratio is high.

In comparison, the shape factors SF-1 and SF-2 of the carrier with high electrical resistance are in a range of 100–140 and a range of 100–120; the surface of a carrier particle is not as rough as that of the ferrite type carrier particle. In other words, the contact surface between a carrier particle of this embodiment and a toner particle is not as large as that between the ferrite type carrier particle and a toner particle, which means that the carrier in this embodiment does not give to the toner as much triboelectrical charge as the ferrite type carrier. Further, the resistivity of the carrier with high electrical resistance is rather high, that is in a range of $10^{10}$–$10^{14}$ Ω·cm, and therefore, it is liable to accumulate the electrical charge which it receives while triboelectrically charging the toner, and the polarity of which is opposite to the polarity of the toner. In other words, the carrier with the high electrical resistance is liable to be saturated with electrical charge. Therefore, in the case of the carrier with high electrical resistance, the amount of the charge the toner receives changes very little even if the T/C ratio changes substantially; as the T/C ratio increases, the amount of the electrical charge the toner receives dips only slightly when the T/C ratio is in an approximate range of 5.5–8.5%; that is, it virtually does not change.

In essence, according to one of the aspect of this embodiment, the change in the amount of the toner charge attributable to the change in the T/C ratio is controlled by employing, as the magnetic carrier of the two component developer, the aforementioned magnetic carrier with high electrical resistance, the toner-charging-capacity of which is as described above. This in turn reduces change in the strength of the force which is generated between adjacent two toner particles by the electrical charge of the toner particles in the direction to cause the toner particles to repel against each other. This in turn reduces the change in the bulk density of the developer attributable to the change in the strength of the force generated between adjacent two toner particles. As described above, another aspect of this embodiment is the same as the aspect of the preceding embodiment. In other words, in this embodiment, the change in the bulk density of the developer is reduced by employing, as the toner of the two component developer, a polymer type toner composed of spherical toner particles, and also employing, as the carrier of the two component developer, a polymer resin type carrier. Further, a coil type density sensor is employed as the toner density sensor of the developing apparatus. Therefore, the output fluctuation of the toner density sensor is further reduced in comparison to the preceding embodiment; the T/C ratio (toner density) can be more accurately detected, that is, at a level one step higher than the accuracy level in the preceding embodiment.

While the invention has been described with reference to the structures disclosed herein, it is not confined to the details set forth, and this application is intended to cover such modifications or changes as may come within the purposes of the improvements or the scope of the following claims.

What is claimed is:

1. A developing apparatus comprising:

a developer container for accommodating magnetic carrier and non-magnetic toner, said developer container including a developing chamber and a stirring chamber through which the developer circulates;

wherein the magnetic carrier and the non-magnetic toner have shape factors of SF-1 of 100–140 and SF-2 of 100–120;

a developer carrying member, provided in an opening of said developing chamber, for carrying the developer;

magnetic field generating means, provided in said developer carrying member, for generating a magnetic field;

detecting means for detecting a toner content in said stirring chamber using a magnetic permeability of the developer in said stirring chamber; and wherein said detecting means is provided on a side wall of said stirring chamber apart from said magnetic field generating means.

2. An apparatus according to claim 1, wherein the carrier is polymerized carrier produced through a polymerization method.

3. An apparatus according to claim 2, wherein the carrier comprises binder resin, magnetic metal oxide and non-magnetic metal oxide.

4. An apparatus according to claim 2, wherein the carrier has a specific resistance of $10^{10}$–$10^{14}$ Ohm.cm.

5. An apparatus according to claim 1, further comprising a developer regulating member, provided below said developer carrying member, for regulating an amount of the toner on said developer carrying member.

6. An apparatus according to claim 5, wherein the developer discharged from a bottom part thereof by movement of said developer carrying member is collected at an upper part.

7. An apparatus according to claim 1, wherein the developer carrying member is supplied with an AC-biased DC voltage.

8. An apparatus according to claim 1, wherein the toner is produced by polymerization.

9. An apparatus according to claim 1, further comprising stirring means for stirring and feeding the developer in said stirring chamber, wherein said detecting means is disposed to oppose the stirring means on a side of said stirring chamber opposite from said magnetic field generating means.

10. An apparatus according to claim 9, wherein said stirring means includes a screw.

11. An apparatus according to claim 1, wherein said detecting means includes a coil sensor.

12. An apparatus according to claim 1, wherein said developer container includes a partition between said developing chamber and said stirring chamber, said partition being provided with an opening through which the developer circulates.

* * * * *